US005589095A

United States Patent [19]

Yuan et al.

[11] Patent Number: 5,589,095

[45] Date of Patent: Dec. 31, 1996

[54] COOLANT/LUBRICANT FOR MACHINING OPERATIONS

[75] Inventors: Lin-Sen Yuan, Westlake Village, Calif.; Lu Yuan, Shanghai, China

[73] Assignee: Hughes Aircraft Company, Los Angeles, Calif.

[21] Appl. No.: 315,787

[22] Filed: Sep. 30, 1994

[51] Int. Cl.[6] ..... C10M 173/02

[52] U.S. Cl. ..... 508/168

[58] Field of Search ..... 252/18, 49.3, 58

[56] References Cited

U.S. PATENT DOCUMENTS

| | | | |
|---|---|---|---|
| 1,935,774 | 11/1933 | Halborg | 29/95.1 |
| 1,945,535 | 2/1934 | Schlitz . | |
| 2,392,481 | 1/1946 | Kaplan et al. | 29/95.1 |
| 2,849,107 | 8/1958 | Logue, Jr. | 252/49.3 |
| 3,170,878 | 2/1965 | Armstrong | 252/18 |
| 3,249,538 | 5/1966 | Freier | 252/18 |
| 3,392,117 | 7/1968 | Glasson | 252/49.3 |
| 3,624,242 | 11/1971 | Steinacker | 252/58 |
| 4,038,730 | 8/1977 | Tersch | 29/95.1 |
| 4,257,902 | 3/1981 | Singer | 252/18 |
| 4,409,113 | 10/1983 | Bertell | 252/49.3 |
| 4,498,361 | 2/1985 | Grace | 76/101 R |
| 4,808,324 | 2/1989 | Periard et al. | 252/23 |
| 4,996,108 | 2/1991 | Divigalpitiya et al. | 428/411.1 |
| 5,116,521 | 5/1992 | Fujii et al. | 252/18 |
| 5,277,831 | 1/1994 | Hanano | 252/21 |
| 5,279,749 | 1/1994 | Hanano | 252/21 |
| 5,294,355 | 3/1994 | King et al. | 252/28 |
| 5,407,590 | 4/1995 | Salvia | 252/58 |

FOREIGN PATENT DOCUMENTS

| | | |
|---|---|---|
| 435190 | 10/1935 | United Kingdom . |
| 551551 | 3/1943 | United Kingdom . |
| 852831 | 11/1960 | United Kingdom . |
| 2002812 | 8/1977 | United Kingdom . |

OTHER PUBLICATIONS

Y. Linsen, "A New Broaching Technology For Drilling Small Deep Precise Holes", Journal of Tongii University, 1985, pp. 117–125.

A. G. Kaleshin et al, "Broaching Deep Holes in Cast Iron", Machine and Tooling, vol. 34, No. 10, Oct. 1963, pp. 32–34.

*Primary Examiner*—Jerry D. Johnson

*Attorney, Agent, or Firm*—V. D. Duraiswamy; W. K. Denson-Low

[57] ABSTRACT

A non-toxic coolant/lubricant is provided which is specifically designed for use in extremely high-load, high-stress machine operations, such as broaching. The composition of this coolant/lubricant includes about 8 to 15 wt % of molybdenum disulfide ($MoS_2$) powder; about 2 to 6.6 wt % of soap flakes; about 6 to 12 wt % of a liquid polytetrafluoroethylene suspension; and about 66.4 to 84 wt % water. The liquid polytetrafluoroethylene component, which is a water-based suspension of polytetrafluoroethylene, serves as a replacement for toxic $CCl_4$, which has been used to increase lubricity in coolant/lubricants comprising molybdenum disulfide. The replacement of $CCl_4$ with liquid polytetrafluoroethylene in the present composition results in a non-toxic but still highly effective coolant/lubricant.

10 Claims, 2 Drawing Sheets

COOLANT/LUBRICANT FOR MACHINING OPERATIONS

CROSS-REFERENCE TO RELATED APPLICATION

The present application is related to application Ser. No. 08/083,244, filed Jun. 24, 1993, which discloses and claims a broaching tool, a method of forming a finishing hole using the broaching tool, a broaching method, and a lubricant and coolant composition for use with the broaching tool. The present application is directed to an improved lubricant and coolant composition for machining operations using cutting tools including broaching.

BACKGROUND OF THE INVENTION

1. Field of the Invention

The present invention generally relates to the art of machining, and, more particularly, to a coolant/lubricant for forming small, deep holes with high precision and surface finish. The new coolant/lubricant is especially formulated for use with high toughness and high strength metal alloys.

2. Description of the Related Art

Machine operations involving cutting processes such as milling, drilling, broaching, and the like require a coolant/lubricant to aid in the machining. Of particular interest are improved lubricants/coolants for applications involving (1) machining of high strength, high toughness metal alloys and (2) high load and high stress machining operations. The following description is directed to the broaching process; however, it will be understood that this is merely an exemplary process in the use of lubricants/coolants.

Machining of small, deep holes with high precision and surface finish is a problem which has persisted in the art. A small, deep precise hole can be defined as having a diameter of less than 12 millimeters, an aspect (depth/diameter) ratio of at least 5, a precision of ISO standard H6–H7, an angular tolerance of H6, a surface roughness of 0.2 to 0.4 micrometer, and a bore out-of-roundness, cylindrical out-of-roundness and taper which are within ⅓ to ½ of the tolerance.

Prior art methods for machining small, deep holes include drilling and expanding followed by rough and fine reaming, rough and fine boring, or boring and grinding. Other methods include honing and electron discharge machining (EDM). These prior art methods suffer from the drawbacks of multiple complex machining processes, extreme difficulty in obtaining satisfactory precision, surface finish and exchangeability, low productivity, poor quality control, high reject rate, and often conical deformation at the exit ends of the holes.

Broaching is a process for machining holes, slots, and grooves with high productivity compared to the methods described above. Broaching can be used for forming holes in numerous metals including low-carbon steel, low-carbon alloy steel, phosphor bronze, pure aluminum, stainless steel, titanium alloys, and other materials.

A broaching tool generally includes an elongated body on which a number of parallel cutting teeth are formed or attached. The diameters of the teeth progressively increase from the front end to the rear end of the tool by an increment known as the "rise", such that each tooth cuts slightly deeper than the previous tooth.

A basic broaching tool and method are described in U.S. Pat. No. 1,945,535, entitled "BROACHING TOOL", issued Feb. 6, 1934 to B. Schlitz. A method of fabricating a basic broaching tool is described in U.S. Pat. No. 4,498,361, entitled "BROACH MANUFACTURING METHOD", issued Feb. 12, 1985 to W. Grace.

Broaching as practiced conventionally has not achieved its potential for forming small, deep holes with high precision and surface finish. This is due to a number of fundamental problems which have remained unsolved.

As the broaching tool is forced through the workpiece, high friction and specific pressure between the front face of each cutting tooth and the compressed material ahead of the tooth generate a large amount of heat which results in the formation of a layer of material which clings to the front face of the tooth and is known as a "built-up edge".

Certain "sticky" materials such as stainless steel are particularly prone to the formation of built-up edges due to their high elasticity, percentage elongation, and plastic deformation characteristics. The frictional forces and pressures between the chips generated during broaching, the broaching tool, and the workpiece are especially high for these materials, causing chips to break away from the workpiece that cause scaling of the surface of the hole and further enabling the built-up edge to grow to an undesirably large size. This causes the diameter of the hole to progressively increase, and creates a "nibbled" surface finish with a high degree of roughness.

If the built-up edge grows to a large size and then fractures off, the hole will have a surface with band-shaped scaling. Because cooling and lubrication are relatively ineffective in the lower portion of a deep hole which is being formed by vertical broaching, the scaling bands generally appear in the lower half of the hole.

There are four aspects of a coolant/lubricant to consider:

(1) It lubricates the cutting edge/chip/workpiece interfaces so that the chips will slide over the cutting tool surfaces with a minimum of friction and therefor generate a minimum of frictional heat and cutting tool abrasion. The coolant/lubricant also prevents built-up at cutting edges and extends useful life of the cutting tool.

(2) It conducts away heat generated by the separation of the chips from the workpiece and also the heat generated by the cutting edge's trailing edge which slides over the workpiece surface.

(3) It must penetrate and adhere at all the interfaces between the cutting tool and parts. To achieve this, sufficient volume of the coolant/lubricant fluid and pressure is required.

(4) It must not be corrosive to surfaces.

Satisfying these requirements, a well-formulated coolant/lubricant adds greatly to the production of smooth cutting surfaces and long cutting tool life.

Ineffective cooling and lubrication not only result in poorer quality holes due to occurrence of build-up edges, but also fail to protect the broaching tool itself from wear. The large heat concentration at the cutting point of the tool causes loose chips to fuse to the cutting tool edge, eventually blunting the tool. Once begun, the deterioration of a blunted broaching tool accelerates with use because a blunted tool generates more heat and results in more loose chips for fusion to the tool edge. Consequently, the service life of the broaching tool is shortened by inadequate lubrication and cooling, and the holes machined by the worn, blunted broaching tools have rough surface finishes and are generally of poor quality.

Prior art lubricants and coolants, including conventional cutting oils such as engine oil, spirdel oil, sulfurizing oil, and emulsions, are incapable of adequately preventing built-up cutting edges and reducing the frictional forces, temperatures, and pressures created during broaching small, deep holes. This lack of effective lubrication and cooling for broaching operations has limited the precision and surface finish of holes formed by broaching and has shortened the service life of broaching tools.

A coolant/lubricant specifically designed for the rigors of the broaching process is described in a pending application entitled "HIGH PRECISION, HIGH SURFACE FINISH BROACHING METHOD, TOOL, AND COOLANT/LUBRICANT", application Ser. No. 08/083,244, filed Jun. 24, 1993, in the name of Lin-Sen Yuan, one of the present inventors. The coolant/lubricant of that application comprises a molybdenum disulfide power dispersed in a liquid suspension of soap and water. In an alternative embodiment claimed within that application, the liquid suspension also includes kerosene, chloroparaffin, and carbon tetrachloride ($CCl_4$). The use of $CCl_4$ is to minimize sticking and prevent built-up cutting edges.

While the coolant/lubricant of that application overcomes the limitations of prior art lubricants and coolants described above regarding the broaching process, its use of the toxic chemical $CCl_4$ is a concern for environmental and safety reasons. Moreover, the use of $CCl_4$ is heavily regulated due to its toxicity, so that the cost of using $CCl_4$ is effectively increased.

Further, the two classes of lubricants/coolants mentioned above function well only for different types of metals. The moly/soap/water formulation functions well for non-alloy metals, such as carbon steel, copper, etc., while the coolant/lubricant using $CCl_4$ functions well for alloy metals, such as stainless steel.

Thus, a need remains for a non-toxic coolant/lubricant that can provide substantially the same level of lubrication and cooling in the harsh environment of machinging operations involving cutting currently achieved by molybdenum disulfide power dispersed in a liquid suspension of soap, $CCl_4$, and water. The coolant/lubricant should also be convenient to store and transport.

SUMMARY OF THE INVENTION

In accordance with the present invention, a non-toxic coolant/lubricant is provided which is specifically designed for use in extremely high-load, high-stress machine operations, such as broaching. The present coolant/lubricant includes the use of a water-based suspension of extremely fine Teflon (polytetrafluoroethylene) liquid (60% solids) mixed in a water-based slurry of $MoS_2$ and soap. (Teflon is a trademark of E. I. dupont de Nemours, Wilmington, Del.) The water-based suspension of Teflon, also termed "liquid Teflon", serves as a replacement for toxic $CCl_4$, which has been used to increase lubricity in previous coolant/lubricants comprising molybdenum disulfide, as described above.

The coolant/lubricant of the present invention is substantially more effective in the harsh environment of broaching operations than conventional cutting oils such as engine oil. The superiority of the present coolant/lubricant is particularly evident in the lower portion of broached holes, where extreme temperatures and pressures have been problematic for conventional cutting oils. The exceptional lubricity and cooling provided by the present composition enable the production of precision holes with highly polished surfaces, and low surface tension and strong capillary action of the composition extend the service life of broaching tools by removing loose chips from the cutting edge.

Thus, the benefits of a coolant/lubricant comprising molybdenum disulfide are realized in the practice of the invention without resorting to the inclusion of toxic chemicals such as $CCl_4$. Rather, the replacement of $CCl_4$ with liquid Teflon in the present composition results in a non-toxic but still highly effective coolant/lubricant.

Use of the present composition is also economically prudent. The resulting reduction in rejection rate for manufactured parts as well as the extension of broaching tool service life translate to decreased manufacturing costs. Further, the present coolant/lubricant is inexpensive to produce, in that it simply involves mixing readily-available components in a simple mechanical mixer. It requires no special transportation or storage arrangements, since it may be transported in concentrated paste form and is chemically stable at temperatures ranging from −25° to 70° C. in its final hydrated form. Moreover, cleaning up this aqueous-based coolant/lubricant is easily accomplished using ordinary water. This coolant/lubricant has potential application in other high-load, high-stress machining operations aside from broaching. For example, the benefits of the present invention extend to such operations as high-speed cutting, drilling, milling, the making of gears, turning, reaming, coring, legging, drawing of wires, drawing of tension bars, drawing of tubes, and making screws.

These and other features and advantages of the present invention will be apparent to those skilled in the art from the following detailed description, taken together with the accompanying drawing.

DETAILED DESCRIPTION OF THE INVENTION

The discussion which follows is directed to one specific example of a cutting tool, namely, a broaching tool. However, it will be appreciated that the present invention is not limited to the use of broaching tools, but can be used for machining operations with many different types of cutting tools. The broaching tool is discussed below merely as an example to aid in the understanding of the present invention.

Figure 1:
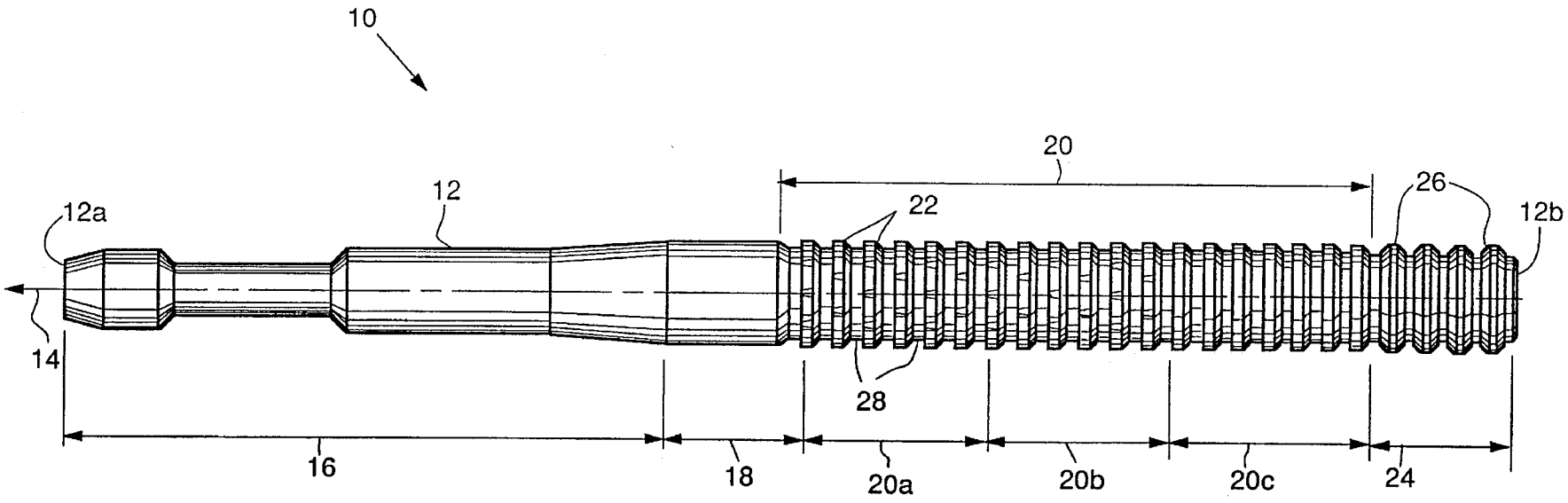
FIG. 1 is a side elevation view illustrating a cutting tool, here, a broaching tool, to be benefited by the coolant/lubricant of the present invention.

A pull broaching tool 10 benefited by the lubricant/coolant of the present invention is illustrated in FIG. 1 for broaching small, deep precision holes with high surface finish. The present tool 10 is capable of broaching holes having a diameter of approximately 5 to 50 millimeters, aspect (depth/diameter) ratio of approximately 1 to 25, precision of ISO standard H6 to H7, angular tolerance of H6, surface roughness of 0.1 to 0.4 micrometer, and bore out-of-roundness, cylindrical out-of-roundness and taper which are within ⅓ to ½ of the tolerance.

The tool 10 includes a body 12 having a front end **12*a* and a rear end 12*b*, and is intended to be pulled leftwardly as indicated by an arrow 14 through a hole for broaching. The left end portion of the body is formed into a pull shank 16** to enable it to be gripped by the jaws of a conventional broaching machine (not shown).

A cylindrical front pilot 18 is formed on the body 12 rearward (rightward) of the pull shank 16. The front pilot 18 has a diameter which is equal to or slightly smaller than the initial diameter of a hole to be broached for smoothly guiding the tool 10 into the hole.

A cutting section 20 including a plurality of annular cutting teeth 22 is formed in the body 12 rearward of the front pilot 18. The cutting section 20 can include a continuous set of cutting teeth of the same type, or can, as illustrated, include a roughing section 20*a*, a semi-finishing section 20*b* and a finishing section 20*c* having teeth of different types. A rear pilot 24 including rings or smoothing teeth 26 is formed after the cutting section 20.

A method of broaching using the tool 10 generally includes the steps of forming a hole through a workpiece, and then pulling the tool 10 through the hole to increase the diameter and improve the precision and surface finish of the hole. Preferably, a pilot hole will be formed by drilling or casting. The intended finished diameter D of the broached hole is larger than the diameter of the pilot hole by an amount ΔD which is selected in accordance with the precision and surface finish of the secondary hole.

In all cases, the broaching tool should be maintained as concentric with the hole as possible. The higher the concentricity, the higher the precision and surface finish that can be achieved. The diameter increase ΔD to be accomplished by broaching and the precision of the finished hole are limited by the precision of the pilot hole, including geometric parameter such as straightness, ellipticity, and taper.

Prior art lubricants/coolants based on conventional cutting oils such as engine oil, spirdel oil, and sulfurized oil, are not sufficiently effective to enable small, deep holes to be broached with high surface finish using conventional broaching tools, especially in the lower portions of the holes. Conventional cutting oils are also ineffective in preventing chips from sticking to the cutting teeth. Alternatively, a recently developed coolant/lubricant based on a molybdenum disulfide powder dispersed in a liquid suspension including soap, water, and carbon tetrachloride ($CCl_4$) provides lubrication and cooling superior to that offered by conventional cutting oils, but suffers the disadvantage of toxicity due to the presence of $CCl_4$.

The present composition offers the superior lubrication and cooling properties of $MoS_2$-based products while eliminating $CCl_4$ as a source of toxicity. The present coolant/lubricant includes soap paste, molybdenum disulfide ($MoS_2$) powder dispersed in a suspension of the soap paste, "liquid Teflon", and water. More specifically, the composition of this coolant/lubricant includes about 8 to 15 wt % $MoS_2$; about 2 to 6.6 wt % soap; about 6 to 12 wt % liquid Teflon suspension; and about 66.4 to 84 wt % water.

Molybdenum disulfide ($MoS_2$) is a powdery solid that offers good lubricity, adhesion, heat resistance, non-corrosivity, and low friction under high compressive force. In the practice of the invention, it is preferable that the purity of the $MoS_2$ used be at least 98% and that the powder size be less than 1.5 μm. Given that $MoS_2$ is a powder, this component must be dispersed in a suitable liquid suspension to avoid precipitation in solution. The present invention uses a soap paste to encapsulate the $MoS_2$ powder, thereby successfully enhancing its suspendability in water.

The so-called "liquid Teflon" used in the practice of the invention comprises a dry polytetrafluoroethylene (also designated as $(C_2F_4)_n$ or Teflon) powder suspended in water plus a surfactant, the dry Teflon powder being a fine amorphous powder representing about 58 to 62 wt % of the total suspension. Liquid Teflon is commercially available from DuPont under the tradename Teflon 30 and from Shanghai Rubber under the tradename PTFE (Emulsified Polytetrafluoroethylene). As available from dupont, the surfactant may be present in an amount ranging from 0 to about 5 wt % and comprises either octyl phenoxypolyethoxyethanol or nonyl phenoxypolyethoxyethanol.

Liquid Teflon offers many desirable qualities to the coolant/lubricant of the present invention, including low friction coefficient, superior chemical stability, low surface tension, strong capillary force, low adhesion, and good penetration properties. Further, liquid Teflon is highly wettable.

The soap is preferably a sodium fatty-acidulate having the chemical composition $(C_nH_{2n+1})$-COONa, where n ranges from 8 to 18, including approximately 96% sodium fatty-acidulate soap and the balance, approximately 4%, water. The soap takes the form of dry flakes prior to its combination with water.

The water used in the practice of the invention is preferably a soft water and is, most preferably, substantially deionized water.

One gallon of the preferred coolant/lubricant composition comprises (from experimental evidence):

| Component | Amount (pounds) | Amount (kg) | Wt % |
|---|---|---|---|
| soap (chips) | 0.13 to 0.44 | 0.06 to 0.20 | 2 to 6.6 |
| $MoS_2$ (powder) | 0.60 to 1.1 | 0.27 to 0.50 | 8 to 15 |
| liquid Teflon (60% solids) | 0.44 to 0.88 | 0.20 to 0.40 | 6 to 12 |
| water | 4.42 to 5.54 | 2.01 to 2.52 | 66.4 to 84 |

The coolant/lubricant of the present invention is prepared by producing a soap paste by mixing the soap flakes with water. All of the $MoS_2$ is then added to the soap paste to form a $MoS_2$/soap paste, to which all of the liquid Teflon is added to form a $MoS_2$/soap/liquid Teflon paste. Finally, water is added to the $MoS_2$/soap/liquid Teflon paste to form a smooth, free-flowing liquid that represents the final coolant/lubricant product. A simple mechanical mixer may be used to mix the components.

By way of example, the following procedure has been used to produce one gallon (3.875 liters) of a specific composition of the coolant/lubricant of the present invention:

1. Mix 130 grams of soap flakes with 650 grams of water to form a soap paste;

2. Mix 385 grams of $MoS_2$ powder with the soap paste to form $MoS_2$/soap paste;

3. Mix 306 grams of liquid $C_2F_4$ with the $MoS_2$/soap paste to form $MoS_2$/soap/liquid $C_2F_4$ paste; and 4. Add balance of water to the $MoS_2$/soap/liquid $C_2F_4$ paste to form 3.875 liters (1 gallon) of coolant/lubricant.

The coolant/lubricant is coated on the cutting tool prior to cutting. The coolant/lubricant may also be coated on the workpiece to be machined. With particular reference to the broaching tool shown in FIG. 1, the coolant/lubricant is coated on the broaching tool 10 prior to broaching, with care being taken to ensure that the slots 28 of the cutting teeth 22 are completely filled with the coolant/lubricant.

EXAMPLE

The coolant/lubricant of the present invention was used to form a plurality of holes in a workpiece comprising steel SAE 4620 MOD. The composition of the coolant/lubricant comprised 4.3 wt % soap (Norfox 92, available from Norman, Fox & Company), 11.5 wt % $MoS_2$, 9 wt % liquid Teflon (60% solids), 75.2 wt % water.

Figure 2:
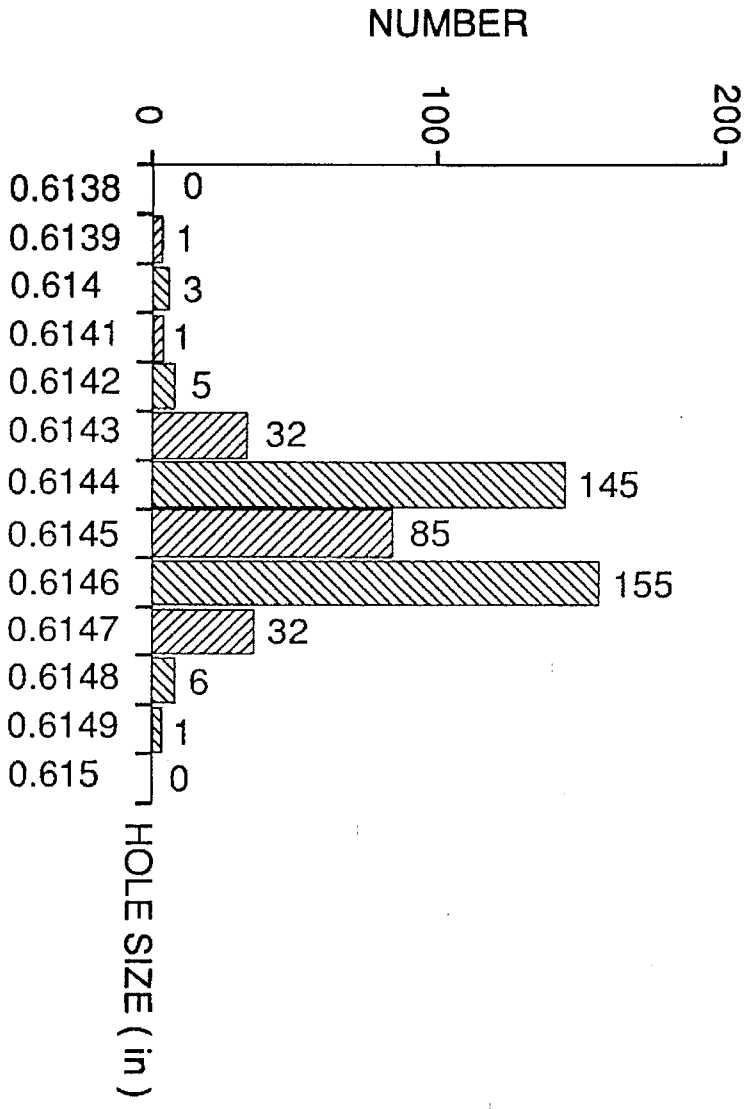
FIG. 2, on coordinates of number of holes and hole size, is a statistical distribution of the hole sizes obtained during one typical experiment using the coolant/lubricant of the present invention.

FIG. 2 shows the statistical distribution of hole sizes in one typical experiment using the coolant/lubricant of the present invention. The Table below shows the improvement when compared to the use of 329 Soluble Oil, available from Castrol Industrial, which is an emulsion-type lubricant.

| | Precision (<0.0002") | Surface Roughness | Rejection Rate |
|---|---|---|---|
| Emulsion-Type Lubricant | 45% | 1.3 to 3.2 μm | 10% |
| Present Coolant/Lubricant | 83% | 0.2 to 0.4 μm | 1.3% |

The above Table shows that (1) the number of parts whose hole size precision that is better than (i.e., less than) 0.0002 inch improves from 45% to 83% of the total parts, (2) surface roughness improved to only 0.2 to 0.4 μm, or about 1/10 that provided by the prior art lubricant, and (3) rejections of parts was a low 1.3%.

While illustrative embodiments of the invention have been shown and described, numerous variations and alternate embodiments will occur to those skilled in the art without departing from the spirit and scope of the invention.

For example, the weight percentages described above are preferred values and should not be considered as limiting the scope of the invention. These ratios can be varied within substantial ranges as required for particular applications. It will be further understood that the present lubricants/coolants are not limited to broaching and can be used for other cutting and machining operations.

Accordingly, it is intended that the present invention not be limited solely to the specifically described illustrative embodiments. Various modifications are contemplated and can be made without departing from the spirit and scope of the invention, as defined by the appended claims.

What is claimed is:

1. A high-load, high-stress machining coolant and lubricant composition, consisting essentially of a suspension of:

(a) about 8 to 15 wt % molybdenum disulfide;

(b) about 2 to 6.6 wt % of a sodium fatty-acidulate soap;

(c) about 6 to 12 wt % liquid polytetrafluoroethylene suspension; and (d) about 66.4 to 84 wt % water, said water being in addition to such water as is intrinsically associated with said sodium fatty-acidulate soap and said liquid polytetrafluoroethylene suspension.

2. The coolant and lubricant composition of claim 1, in which said molybdenum disulfide has an average particle size of less than about 1.5 μm.

3. The coolant and lubricant composition of claim 1, in which said soap comprises about 96% sodium fatty-acidulate and about 4% water.

4. The coolant and lubricant composition of claim 1, in which said sodium fatty-acidulate soap has the chemical composition $(C_nH_{2n+1})$-COONa, where n ranges from 8 to 18.

5. The coolant and lubricant composition of claim 1, in which said liquid polytetrafluoroethylene suspension comprises about 58 to 62 wt % polytetrafluoroethylene, up to about 5 wt % of a surfactant, and the balance water.

6. A method for preparing a high-load, high-stress machining coolant/lubricant for use in machining operations, comprising formulating said coolant/lubricant by combining about 2 to 6.6 wt % of soap in sufficient water to form a paste, then adding about 8 to 15 wt % of molybdenum disulfide, next adding about 6 to 12 wt % of liquid polytetrafluoroethylene suspension, and finally adding water to an amount ranging between about 66.4 to 84 wt %, said water being in addition to such water as is intrinsically associated with said soap and said liquid polytetrafluoroethylene suspension.

7. The method of claim 6, in which said molybdenum disulfide has an average particle size of less than about 1.5 μm.

8. The method of claim 6, in which said soap comprises about 96% sodium fatty-acidulate and about 4% water.

9. The method of claim 6, in which said soap has the chemical composition $(C_nH_{2n+1})$-COONa, where n ranges from 8 to 18.

10. The method of claim 6, in which said liquid polytetrafluoroethylene suspension comprises about 58 to 62 wt % polytetrafluoroethylene, up to about 5 wt % of a surfactant, and the balance water.

* * * * *